US005561428A

United States Patent [19]

Czaja et al.

[11] Patent Number: 5,561,428

[45] Date of Patent: Oct. 1, 1996

[54] ELECTROMAGNETIC RADIATION ABSORBER AND METHOD FOR THE PRODUCTION THEREOF

[75] Inventors: Stan Czaja, Newbury Park; Perin Winchell, Del Mar; Benjamin B. Meckel, San Diego, all of Calif.

[73] Assignee: General Atomics, San Diego, Calif.

[21] Appl. No.: 700,648

[22] Filed: Feb. 12, 1985

[51] Int. Cl.[6] ..... H01Q 17/00

[52] U.S. Cl. ..... 342/1

[58] Field of Search ..... 343/18 A; 342/1–3; 333/22

[56] References Cited

U.S. PATENT DOCUMENTS

| | | | |
|---|---|---|---|
| 2,293,839 | 8/1942 | Linder | 342/1 X |
| 2,977,591 | 3/1961 | Tanner | 342/1 |
| 3,568,196 | 3/1971 | Bayrd | 343/18 A |
| 4,012,738 | 3/1977 | Wright | 343/18 A |
| 4,287,243 | 9/1981 | Nielsen | 343/18 AX |
| 4,538,151 | 8/1985 | Hatakeyama et al. | 342/1 |

OTHER PUBLICATIONS

Sands et al., "Darkflex a Fibrous Microwave Absorber", NRL Report, 1953.

McMillan Industrial Corporation, "Microwave Absorbers", Technical Publication, Circa 1957.

*Primary Examiner*—Mark Hellner

*Attorney, Agent, or Firm*—Juettner Pyle Lloyd & Piontek

[57] ABSTRACT

Disclosed herein is an electromagnetic radiation absorber comprising a filamentary, three-dimensional, porous substrate of dielectric material having a relatively thin layer of electrically conductive material deposited thereupon. The layer is characterized by a generally gradual and continuous reduction in its thickness or bulk with inward progression into the substrate from one side thereof, thus resulting in a layer exhibiting a graduated resistivity. A filler substantially pervious to the radiation of interest may be disposed in the interstitial voids between filaments, and relatively small diameter magnetic/magnetizeable particles may be suspended in the filler to thereby further extend the useful frequency range of the absorber. Also disclosed is a sputtering method for producing such an absorber.

14 Claims, 1 Drawing Sheet

FIG. 1
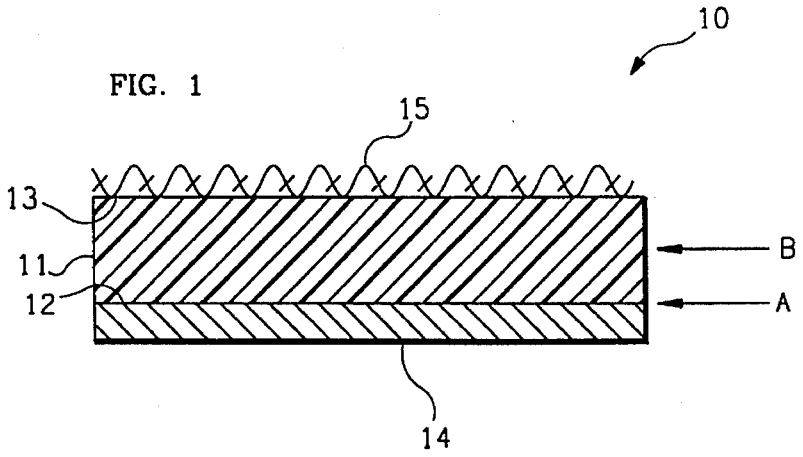
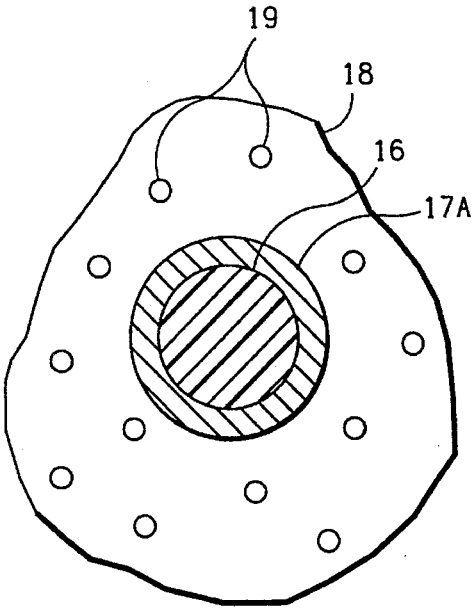
FIG. 1A
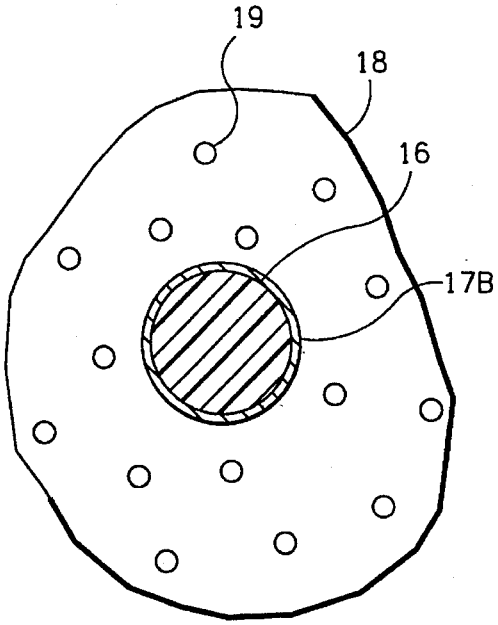
FIG. 1B
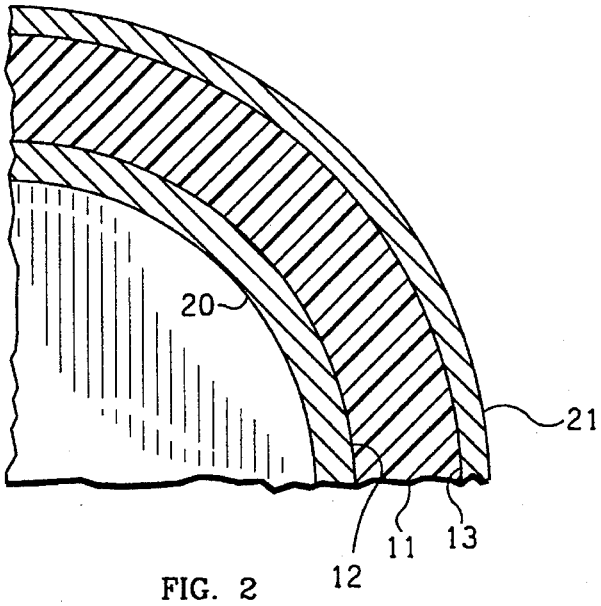
FIG. 2

ELECTROMAGNETIC RADIATION ABSORBER AND METHOD FOR THE PRODUCTION THEREOF

TECHNICAL FIELD

The present invention pertains to absorbers of electromagnetic radiation useful, for example, in protecting a potential military target from radar detection. It also pertains to a method for producing such absorbers.

BACKGROUND ART

The increased variety and sophistication of detectors employed in conjunction with military weapons systems has served to highlight the critical need to better protect potential targets, both ground and airborne, from acquisition. This need is especially acute with respect to the radar frequency band of the electromagnetic spectrum as potential targets operating in the field are vulnerable to acquisition by a large plurality of radar systems operating over a broad band of frequencies, typically ranging from 2 to 200 GHZ.

Under ideal conditions a target can be provided, either during initial manufacture or through post-manufacture retrofit, with an absorber optimized for a particular radar frequency. It is, however, quite another matter to provide an absorber which is useful over a broadband frequency range encompassing the radar frequencies most likely to be encountered. While such broadband absorbers have hitherto been produced, they are typically quite bulky, heavy, and generally ill-suited for operational use in those situations where low bulk and light weight are of paramount importance. Furthermore, even with absorbers satisfying both low bulk and low weight requirements, it often turns out that the absorber construction is so complex as to render impractical its production in an economical manner.

Anechoic chamber technology has resulted in several innovative absorber structures exhibiting both low bulk and low weight. In this regard, U.S. Pat. Nos. 2,977,591; 3,568,196; and 4,012,738 each disclose absorber structures comprising a fibrous mat of non-conducting material having a layer incorporating conductive material therein which is deposited on the mat fibers and extends inwardly into the mat volume from one side thereof. In each patent the aforementioned layer is formed by suspending electrically conductive particles in a liquid binder selected, in part, for its ability to adhere to the mat fibers upon curing. The mat is then either sprayed with or dipped into the liquid mixture in such a manner as to produce a completed structure which contains an electrically conductive layer bound to the mat fibers and consisting of the thusly cured binder and electrically conductive particles. It should be noted that the layer so formed does not also fill the interstitial voids between adjacent fibers, thus maintaining mat porosity, and is characterized by a reduction in its thickness with inward progression from one side of the mat.

The drawbacks associated with such absorbers of the prior art are manifestly clear and include, in addition to the tedious nature of the methods for producing same, the fact that the electrically conductive layer is discontinuous in the sense that it consists of discrete electrically conductive particles bound to the mat fibers by the cured binder. This feature, coupled with the presence of the binder in the layer, detracts from the desired electrical properties of the absorber which would otherwise be obtained if the layer was formed of non-discrete material and free of the binder.

Accordingly, it would be highly desirable and beneficial, and there still exists the need, to provide an absorber which is characterized by having an electrically conductive layer which is substantially free of any materials therein detracting from the electrical properties of the layer, and which comprises a non-discrete electrically conductive layer as opposed to the layers of the prior art comprised of discrete particles. It would also be highly desirable and beneficial to provide an absorber, and a method for producing same, wherein control of the layer thickness with inward progression into the mat structure is more easily facilitated.

DISCLOSURE OF THE INVENTION

In view of the foregoing, it is an object of the present invention to provide an electomagnetic radiation absorber having an electrically conductive layer characterized by continuity of structure in terms of the material from which it is formed, optimal electrical properties, and continuity of reduction in its thickness with inward progression into the absorber.

Another object of the present invention is to provide an electromagnetic radiation absorber having both low bulk and low weight.

A still further object of the present invention is to provide an electromagnetic radiation absorber useful for protecting potential military targets from electromagnetic acquisition or detection.

Yet another object of the present invention is to provide an electromagnetic radiation absorber which is sufficiently flexible such that it can, if desired, be configured to assume the contours of the object it is intended to protect.

A still further object of the present invention is to provide an electromagnetic radiation absorber which may be molded to permanently assume virtually any predetermined geometrical configuration.

Another object of the present invention is to provide an electromagnetic radiation absorber which additionally incorporates therein means for suppressing the infrared radiation produced by the object it is intended to protect.

A still further object of the present invention is to provide an electromagnetic radiation absorber which is useful over a relatively large portion of the electromagnetic radiation spectrum, which is of simplified construction, and which is adapted for manufacture in an economical manner.

Another object of the present invention is to provide a greatly simplified method for producing an electromagnetic radiation absorber which satisfies the above-stated general objects and others.

In accordance with the disclosure herein, an electromagnetic radiation absorber is produced by sputtering from a target of electrically conductive material onto and through one side of a dielectric substrate comprised of a multiplicity of generally randomly oriented and interconnecting filaments defining a three-dimensional porous structure. The porosity of the substrate is such that the electrically conductive material is able to readily penetrate into the porous structure for eventual deposition upon filaments underlying those filaments closest to the sputtering target. By virtue of the "shadowing effect", a reduced amount of electrically conductive material attaches to the underlying filaments, thus resulting in a generally gradual and continuous reduction in the thickness of the electrically conductive layer with inward progression into the substrate.

Additional features of the invention include provisions for reflecting back into the absorber for further attenuation such radiation as penetrates therethrough, for filling the interstitial voids of the substrate to impart enhanced structural characteristics to the absorber and to permit molding the absorber to assume virtually any predetermined contour, for suspending magnetic/magnetizable particles in the interstitial voids of the substrate to further attentuate incoming radiation, and for camouflaging the absorber to reduce the likelihood of its visual detection.

BRIEF DESCRIPTION OF THE DRAWINGS

The above-mentioned and other objects and features of this invention, and the manner of attaining them, will become apparent, and the invention itself will be best understood, by reference to the following description of the invention taken in conjuction with the accompanying drawings, wherein:

FIG. 1 is a partial cross-sectional side view of the preferred embodiment of the present invention;

FIG. 1A is a partial cross-sectional view of the embodiment shown in FIG. 1 at the position identified by reference character A;

FIG. 1B is a partial cross-sectional view of the embodiment shown in FIG. 1 at the position identified by reference character B; and FIG. 2 is a partial cross-sectional side view of another embodiment of the present invention illustrating same assuming the shape of a predetermined contour.

BEST MODE FOR CARRYING OUT THE INVENTION

Referring now to the drawings, and in particular to FIG. 1, it may be seen that according to this invention an electromagnetic radiation absorber 10 may be formed which comprises an absorber member 11, a reflective layer 14 mounted on a side 12 of member 11, and a camouflage layer 15 of fabric mounted on the opposite side 13 of member 11.

Considering absorber member 11 in greater detail, it comprises a sheet of dielectric material formed from a multiplicity of randomly oriented and interconnecting filaments (not shown) which together define a dielectric substrate having a three-dimensional porous structure. While numerous satisfactory materials are available, it is currently preferred that the substrate comprise a sheet of reticulated polyurethane such as is sold by the Crest-Foam Corporation of Moonachie, New Jersey. In the preferred embodiment the dielectric substrate is preferably about ¼ to ½ inches thick, though thicknesses from about ⅛ to 1 inches and larger have proven entirely satisfactory. The substrate should preferably exhibit a porosity of about 5 to 60 pores per inch, with 20 pores per inch currently being preferred, and should preferably have a filament volume which represents about 10% of the total volume of the substrate.

Turning briefly to the reflective layer 14, it preferably comprises a relatively low emissivity metallic sheet, such as aluminum, which is highly reflective towards the electromagnetic radiation of interest. Layer 14 preferably takes the form of metallic foil which is bonded to absorber member 11 using any suitable conventional adhesive.

Layer 15 of the preferred embodiment is necessarily pervious (i.e. - substantially transparent) to the electromagnetic radiation of interest and comprises conventional woven fabric bonded to absorber member 11, such as by conventional adhesives, and bearing a camouflage pattern imprinted on the exteriorly-facing side thereof. Alternatively, conventional camouflage paints can be employed in lieu of or in addition to the fabric.

Turning back to considering absorber member 11, it further includes an electrically conductive layer on the dielectric filaments which is characterized by a gradual and continuous reduction in its thickness or bulk with inward progression into the substrate structure from side 12. This characterizing feature will be more clearly understood by reference to FIGS. 1A and 1B. Each figure illustrates a sectional view of absorber member 11 taken at the positions identified by reference characters A and B in FIG. 1. More particularly, FIG. 1A illustrates a filament 16 located proximate side 12 of member 11, and reference numeral 17A identifies that portion of the electrically conductive layer at that filament location in the substrate. The thickness of layer 17A in FIG. 1A should be compared with the layer 17B in FIG. 1B for such a comparison will quickly reveal a significant difference in the thickness of the electrically conductive layer at those respective locations. In fact, at all locations progressing from A to B, one will find that the electrically conductive layer generally gradually and continuously reduces in thickness. Lest the invention be misunderstood, it should be noted that FIGS. 1A and 1B are of greatly exaggerated dimensions, and are intended merely to illustrate the phenomena that the electrically conductive layer thins out with inward progression into the substrate. These figures are not intended to imply or suggest that the electrically conductive layer is uniformly formed about each filament or that every filament at a specific depth from side 12 necessarily has the same identical amount of electrically conductive material deposited thereon. In point of fact, it is to be expected that the practice of the method of this invention as later described will result in some non-uniformities in the electrically conductive layer on filaments at a given depth in view of the generally random nature of filament orientation and the "shadowing effect" imposed on those filaments by the filaments more closely spaced from side 12. In any event, it should be understood that the electrically conductive layer will generally be of reduced bulk with inward progression from side 12, and as a consequence that the resistivity of the layer will generally gradually and continuously increase from a predetermined value at side 12 up to about infinity at some location within the substrate volume spaced from side 12. This location may occur either at side 13 or at some other intermediate location within the substrate.

As thus far described, electromagnetic absorber 10 is completely satisfactory for protecting an object from radar detection over a relatively broad band of radar frequencies determined by the electrical characteristics of the materials selected for the dielectric substrate and the electrically conductive layer, and by their respective geometries. Such an absorber is inherently flexible and of both low bulk and low weight, thereby making it an especially attractive candidate for protecting potential military targets from radar detection by simply loosely covering the potential target with a large absorber sheet.

In the event that a less flexible, and perhaps even rigid, absorber 10 is desired, the interstitial voids of the substrate can be impregnated with a liquid filler that will cure to form a solid filler mass 18 as shown in FIGS. 1A and 1B. Suitable candidates for such filler include polystyrene, silicone, and other conventional like materials.

It should be noted that whatever filler material is selected, that material should, upon solidification, be as pervious as possible towards the electromagnetic radiation of interest in order to detract as little as possible from the electrical characteristics of the absorber.

Further additional electromagnetic radiation absorption can be realized, particuarly with respect to the shorter wavelengths of the electromagnetic spectrum, by interspersing magnetic/magnetizable particles within the interstitial voids of the substrate. These particles are identified in FIGS. 1A and 1B by the reference numeral 19. For example, the addition of 77 micron particle size magnetite, a ferrite, into the interstitial voids to a fill-factor of about 7% of the interstitial void volume can result in the absorption of electromagnetic radiation lying in the region even below 1 GHZ. In the practice of this invention the magnetic/magnetizable particles are suspended in the liquid filler prior to substrate impregnation, the filler upon curing thus providing support for the particles in the interstitial voids.

The flexibility of absorber 10, coupled with the ability to effect its solidification, lends itself to producing an absorber which is an integral part of the structure of a potential target. Referring to FIG. 2, therein is illustrated a partial sectional view of a curved support member 20 such as would form the external skin of a tank or airplane. Absorber member 11 is bent into a shape complemental to member 20 and attached thereto by any suitable means such as adhesive, or even possibly the aforementioned filler itself whenever the filler is able to produce a sufficiently tenacious bonding with member 20. In the latter regard member 20 could be provided with projections and/or indentations on the side thereof proximate side 12 for receiving the filler prior to curing. Of course, numerous other attachment mechanisms can be employed, either before or after the filler is cured.

A layer of conventional camouflage paint 21 is applied to the side 13 of absorber member 11 to assist in preventing visual detection of the target, as shown in FIG. 2.

An absorber in accordance with this invention is produced by sputtering preselected electrically conductive material, including semiconductive material, from a sputtering target onto one side of the dielectric substrate. The sputtered material thusly penetrates into the porous structure of the substrate and results in the formation of an electrically conductive layer as previously described. A wide variety of candidate materials exist for producing the electrically conductive layer and include, among others, cobalt-chromium, nickel, gold, copper, and aluminum. It is presently preferred that whatever material is selected be deposited in an amount sufficient to yield a resistivity gradient varying from about 1 OHM per square at side 12 of member 11 to about infinity at some position within the volume of member 11. Furthermore, it is also contemplated that some advantages may arise from forming the electrically conductive layer so that it comprises a multi-layer laminate of various materials. In this regard an in-line arrangement of sputtering targets can be employed to rapidly and sequentially form each layer of the laminate.

Following the formation of the electrically conductive layer, be it either a single layer or a multi-layer laminate, the absorber may then be impregnated with the liquid filler, which may additionally contain the magnetic/magnetizible particles, by employing conventional impregnation techniques. Impregnation may precede or follow bending of the absorber to assume a predetermined contour, depending upon the type of impregnation technique employed. Furthermore, curing of the filler may take place either before or after bending of the absorber to assume a contour. The impregnation technique employed, and the step in the method at which the filler is cured, of course depends upon the eventual end use contemplated for the particular absorber under construction.

As a particularized example of an absorber constructed in accordance with the practice of this invention, a 30 cm square gold target is mounted to the cathode of a sputterer in spaced apart and parallel relationship with one side of a reticulated polyurethane sheet measuring approximately 30 cms square and ½ inch thick, the distance therebetween being approximately 40 cms. Sputtering conditions are established by evacuating the sputtering chamber down to about $10^{-6}$ mmHg, and then by backfilling the chamber with 99.9% pure argon. The partial pressure is balanced and maintained by constant evacuation and backfilling with argon using well-known techniques. The sputtering discharge is then enabled and the electrical characteristics at the target are established at about 600 V and 5 ma/cm-square. After approximately one minute the surface of the sheet facing the target will have received approximately 300 A of gold thereupon, corresponding to a resistivity of approximately 1 ohm per square. On the opposite side of the sheet almost no gold will be present and, therefore, the resistivity on that side will be virtually infinite. Between the two sides the resistivity will vary in the manner of a generally continuous gradient.

In view of the foregoing, it will be understood that disclosed herein is an invention which embraces each of the general objects therefor earlier stated. While the invention has been disclosed herein in reference to the preferred form thereof, it will be understood that various changes, rearrangements, and modifications can be made thereto without departing from the essence and scope of the invention as defined in the appended claims. Therefore, it is intended that the present disclosure not be interpreted in a limiting sense and that obvious variants of the invention are comprehended to be within its essence and scope. It should further be understood that reference to the present invention as an absorber of electromagnetic radiation is merely for the purpose of simplifying the discussion inasmuch as some of the incoming radiation is scattered. Accordingly, it is not intended that reference to the invention as an absorber be construed in a limiting sense.

We claim:

1. An electromagnetic radiation absorber, comprising a dielectric substrate formed from a multiplicity of generally randomly oriented filaments defining a three-dimensional porous structure, and a substantially continuous layer of electrically conductive material sputter-deposit on at least some of said filaments and in direct contact therewith, said layer extending inwardly of said substrate from an external surface portion thereof and being characterized by a substantially continuous reduction in its thickness with inward progression from said surface portion.

2. An electromagnetic radiation absorber as set forth in claim 1, further comprising a layer of material reflective to said radiation and mounted on the side of said substrate including said surface portion.

3. An electromagnetic radiation absorber as set forth in claim 1 or claim 2, further comprising a layer of filler material substantially pervious to said radiation and disposed within the voids of said substrate, said filler material imparting enhanced structural characteristics to said absorber.

4. An electromagnetic radiation absorber as set forth in claim 3, further comprising a multiplicity of magnetizable particles substantially randomly dispersed in said layer of filler material.

5. An electromagnetic radiation absorber as set forth in claim 1 or claim 2, further comprising a layer of material pervious to said radiation and mounted on the side of said substrate opposite said surface portion.

6. An electromagnetic radiation absorber as set forth in claim 3, further comprising a layer of material pervious to said radiation and mounted on the side of said substrate opposite said surface portion.

7. An electromagnetic radiation absorber as set forth in claim 4, further comprising a layer of material pervious to said radiation and mounted on the side of said substrate opposite said surface portion.

8. An electromagnetic radiation absorber as set forth in claim 1 or claim 2 wherein said substrate has a porosity within the range of about 5 to 60 pores per inch.

9. An electromagnetic radiation absorber as set forth in claim 1 or claim 2 wherein said layer of electrically conductive material has a resistivity at said surface portion of about 1 ohm per square, said resistivity substantially continuously increasing to a higher value with inward progression into the porous structure of said substrate from said surface portion.

10. An electromagnetic radiation absorber as set forth in claim 2 wherein said layer of material reflective to said radiation is additionally generally highly reflective to radiation in the infrared spectral region and demonstrates generally low infrared emissivity.

11. A method for producing an electromagnetic radiation absorber, comprising the step of sputtering an electrically conductive material onto a surface portion of a dielectric substrate formed from a multiplicity of generally randomly oriented filaments defining a three-dimensional porous structure, said sputtering step proceeding for a time sufficient to deposit said electrically conductive material on said filaments as a layer which is characterized by a substantially continuous reduction in its thickness with inward progression into said substrate from said surface portion.

12. A method as set forth in claim 11 including the additional steps, after the formation of said layer, of impregnating the porous structure of said substrate with a liquid filler, and then solidifying said liquid filler whereby to impart enhanced structural characteristics to said absorber.

13. A method as set forth in claim 12, including the additional step of admixing magnetizable particles in said liquid filler prior to impregnating said substrate.

14. A method as set forth in claim 12 or 13, including the step of binding said substrate to assume a predetermined contour prior to either said impregnation or solidification steps.

* * * * *